US007641276B1

(12) United States Patent
Chen

(10) Patent No.: US 7,641,276 B1
(45) Date of Patent: Jan. 5, 2010

(54) FRAME STRUCTURE FOR A FOLDABLE CHAIR

(76) Inventor: Te-Lung Chen, No.248, Yiling Rd., Render Shiang, Tainan County (TW) 717

( * ) Notice: Subject to any disclaimer, the term of this patent is extended or adjusted under 35 U.S.C. 154(b) by 0 days.

(21) Appl. No.: 12/218,274

(22) Filed: Jul. 15, 2008

(51) Int. Cl.
*A47C 4/00* (2006.01)
*A47C 4/28* (2006.01)

(52) U.S. Cl. ..... 297/42; 297/35

(58) Field of Classification Search ..... 297/42, 297/45, 44, 35, 36, 37
See application file for complete search history.

(56) References Cited

U.S. PATENT DOCUMENTS 6,540,290 B2 * 4/2003 Liu ..... 297/45
6,550,855 B2 * 4/2003 Liu ..... 297/42
6,926,356 B2 * 8/2005 Chen ..... 297/45

FOREIGN PATENT DOCUMENTS

DE 202008000091 U1 * 1/2009
DE 202008000094 U1 * 1/2009

* cited by examiner

*Primary Examiner*—Anthony D Barfield

(57) ABSTRACT

A frame structure for a foldable chair comprises a front interconnecting supporting unit, a rear interconnecting supporting unit, a lateral interconnecting supporting unit, an armrest unit, a seat supporting unit, an armrest unit, and a transverse supporting rod. The front interconnecting supporting unit is installed with a front leg unit, a crisscrossed supporting unit. The rear interconnecting supporting unit comprises a rear leg unit, an arc-shaped supporting unit of which one end of each section is curved in shape. Each of the lateral interconnecting supporting unit includes two board members pivotally crisscrossed connected with each other between the front and rear leg unit. Beneath the armrest unit, a gliding rod is extending along thereof and a connecting joint is protruding there from. The transverse supporting rod is formed with a connecting plate, a rod and a connecting joint.

4 Claims, 10 Drawing Sheets

FRAME STRUCTURE FOR A FOLDABLE CHAIR

BACKGROUND OF THE PRESENT INVENTION

1. Field of the Invention

The present invention relates to a foldable chair, particularly with a seat supporting unit installed between front leg unit and rear leg unit which are parallel to each other and perpendicular to the ground allowing being folded and extended longitudinally.

2. Description of the Related Arts

As shown in FIGS. 7 through 10, the conventional foldable chair is shown to comprise a foldable crisscrossed supporting frame unit and an armrest unit comprising a protrusion plate, a receiving slot and an armrest rod so as to form a foldable structure in the middle portion thereof. However, the conventional invention has disadvantages as following:

Firstly, the foldable structure in the middle of the armrest unit used for enduring the weight of the arms easily becomes loosen up after being bended for several times and the fingers and the arms are easily being clamped and hurt between the joint of the protrusion plate and the receiving slot which could result in safety concern.

Secondly, as shown in FIG. 10, the seat unit is connected with four top points of the front and rear leg units without any support in the central part which would easily be torn apart after being used for a long time.

SUMMARY OF THE PRESENT INVENTION

Please refer to FIGS. 1 through 5, the inventors has improved the design in view of the shortcomings of the prior art. The present invention is to provide a foldable chair which comprises a front interconnecting supporting unit, a rear interconnecting supporting unit, a lateral interconnecting supporting unit, an armrest unit, a seat supporting unit, a transverse supporting rod. The front interconnecting supporting unit and the rear interconnecting supporting unit adapt different length of a crisscrossed supporting unit presenting a X-shape by two board members and an arc-shaped supporting unit with a U and reversed U-shape pivotally connected with each other by four sections of board members respectively, more particularly, the folding distance of the front interconnecting supporting unit is longer than that of the rear interconnecting supporting unit.

DETAILED DESCRIPTION OF THE PRESENT INVENTION

Figure 3:
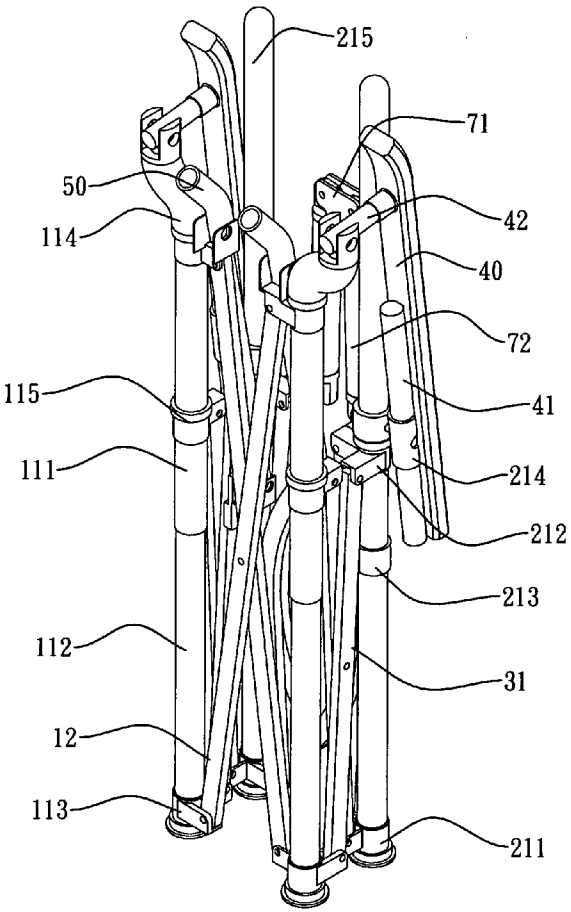
FIG. 3 is a perspective view of the foldable chair frame structure in folding position of the preferred embodiment according to the present invention.
Figure 4:
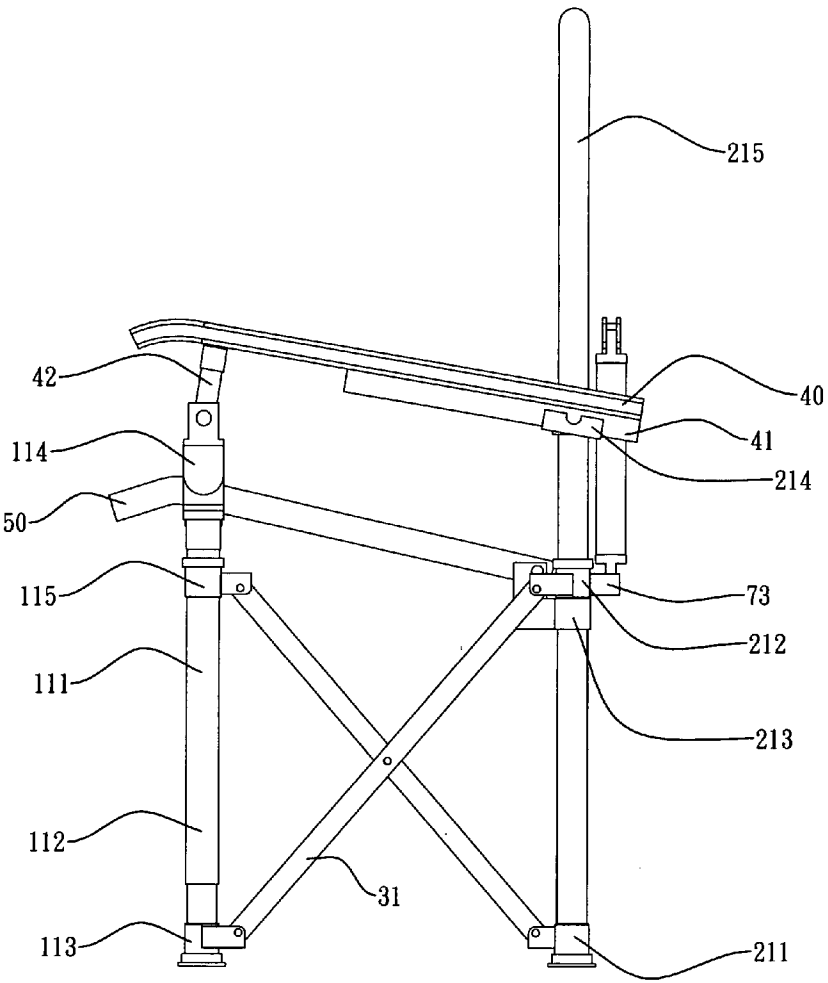
FIG. 4 is a side view of the frame structure of the preferred embodiment according to the present invention.
Figure 5:
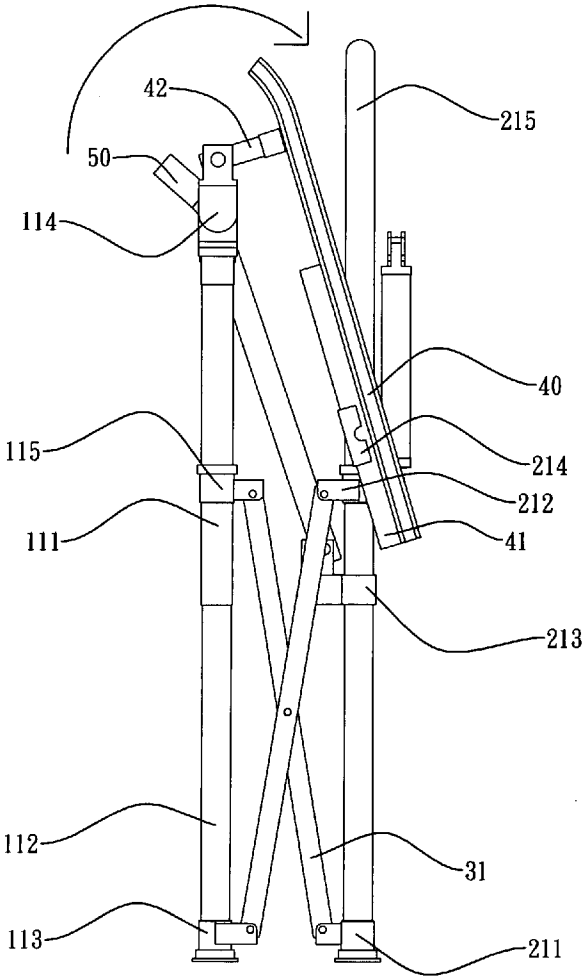
FIG. 5 is a perspective view of the frame structure during folding position of the preferred embodiment according to the present invention.

Please refer to FIGS. 3 through 5, the preferred embodiment of the foldable chair includes a front interconnecting supporting unit (10), a rear interconnecting supporting unit (20), a lateral interconnecting supporting unit (30), an arm rest unit (40), a seat supporting unit (50) and a transverse supporting rod (70). The front interconnecting supporting unit (10) is formed with a front leg unit (11), a crisscrossed supporting unit (12), more particularly, the front leg unit (11) comprises an upper portion and lower portion thereof (111, 112), a front base cap (113), a receiving joint (114), and a front gliding sleeve (115). The upper portion of the front leg unit (111) overlapping the lower portion of the front leg unit (112) is installed on the receiving joint (114) and the front gliding sleeve (115) at the top thereof and the front base cap (113) is positioned at the bottom of the lower portion of the front leg unit (112) so as to complete the front leg unit (11). One board member of the crisscrossed supporting unit (12) is mounted to the receiving joint (114) of one front leg unit (11) with one end and to the front base cap (113) of another front leg unit (11) with another end thereof. Another board member of the crisscrossed supporting unit (12) is mounted to the front base cap (113) of one front leg unit (11) with one end and to the receiving joint (114) of another front leg unit (11) with another end thereof so as to complete the front interconnecting supporting unit (10) with two boards of the crisscrossed supporting unit (12) pivotally connected.

The rear interconnecting supporting unit (20) comprises a rear leg unit (21), an arc-shaped supporting unit (22). Each rear leg unit (21) includes a rear base cap (211), a first rear gliding sleeve (212), a second rear gliding sleeve (213), a rod-bracket track (214), and a rear leg rod (215). The rear base cap (211) is installed at the bottom of each rear leg rod (215). The first rear gliding sleeve (212) and the second rear gliding sleeve (213) below the first rear gliding sleeve (212) are engaged through the rear leg rod (215), more particularly, the first rear gliding sleeve (212) can move along the rear leg rod (215) and the second rear gliding sleeve (213) is fixedly mounted to the rear leg rod (215). The rod-bracket track (214) installed on the rear leg rod (215) is in the shape of semi-cylinder, able to turn forward and backward and positioned above the first rear gliding sleeve (212). One end of each section of the arc-shaped supporting unit (22) is in arc-shaped curve.

The rod-bracket track (214), the first rear gliding sleeve (212), and the second rear gliding sleeve (213) are sequentially engaged through each rear leg rod (215), and the rear base cap (211) is positioned at the bottom of each rear leg rod (215) so as to complete the installation of the rear leg unit (21). One end of the first section of the arc-shaped supporting unit (22) is engaged with the first rear gliding sleeve (212) and another curved end of the first section of the arc-shaped supporting unit (22) is pivotally engaged with the curved end of the second section of the arc-shaped supporting unit (22) with another end engaging with the first rear gliding sleeve (212) of another rear leg rod (215) so as to form a U-shaped foldable structure. One end of the third section of the arc-shaped supporting unit (22) is engaged with the rear base cap (211) of one rear leg rod (215) and another end of the third section of the arc-shaped supporting unit (22) is pivotally connected with the curved end of the fourth section of the arc-shaped supporting unit (22) and another end of the fourth section of the arc-shaped supporting unit (22) is mounted to the rear base cap (211) of another rear leg rod (215) so as to form a reversed U-shaped foldable structure. The rear interconnecting supporting unit (10) is then completed with a U-shaped and a reversed U-shaped frame pivotally connected with each other.

A lateral interconnecting supporting unit (30) is composed of two supporting board members (31) pivotally interconnected between the front and the rear leg unit (11, 21). One end of the first supporting board member (31) is engaged with the front gliding sleeve (115) and another end is engaged with the rear base cap (211); one end of the second supporting board member (31) is engaged with the first rear gliding sleeve (212) and another end is engaged with the front base cap (113) so as to complete the installation of the lateral interconnected supporting unit (30).

Beneath each armrest unit (40), a gliding rod (41) is extending along, and a connecting member (42) is protruding downward there from. Each gliding rod (41) is sliding through the rod-bracket track (214) and the connecting member (42) is engaged with the receiving joint (114) of the front leg unit (11) allowing the armrest unit (40) positioned above the seat supporting unit (50) respectively to form the installation of the arm rest unit (40).

Please refer to FIG. 5, during folding, the armrest unit (40) which positioned on one end of the receiving joint (114) moves upward along with the receiving joint (114) and one end of the rod-bracket track (214) rotates upward together with the rod-bracket track (214) allowing the armrest unit (40) rotating upward against the rod-bracket track (214) so as to fold the whole structure.

The front end of each seat supporting unit (50) is bended with curve and the straight rear end thereof is installed on the rear mounting sleeve (213) of the rear leg unit (21). The receiving joint (114) is suitably joined with the front portion of the seat supporting unit (50) respectively positioning between the front leg unit (11) and rear leg unit (21).

The transverse supporting rod (70) comprises a connecting plate (71), a rod (72), connecting joint (73), wherein one end of the rod (72) is pivotally engaged with the connecting plate (71) with another end pivotally engaged with the connecting joint (73) which is mounted to the rear gliding sleeve (212).

Figure 7:
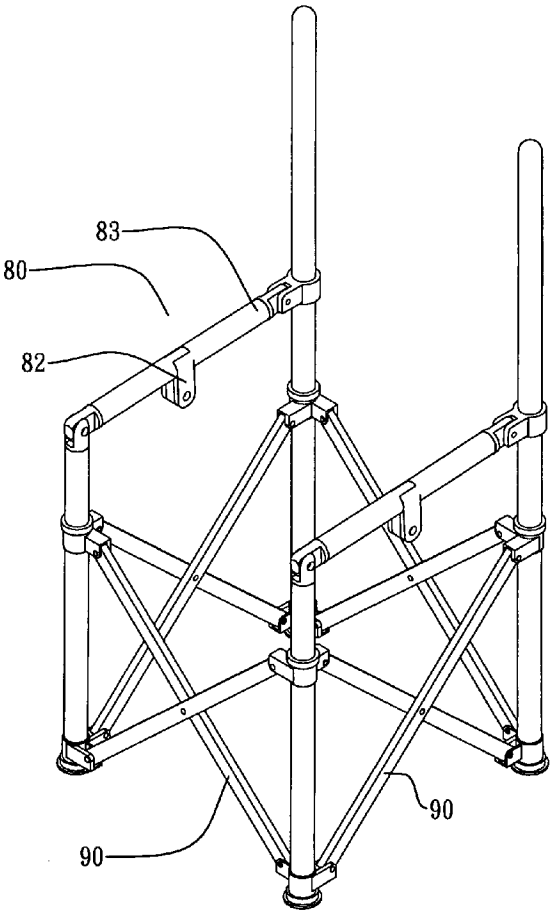
Fig. 7 Prior art
FIG. 7 is a perspective view of the foldable chair frame structure in extension position of the conventional invention.
Figure 8:
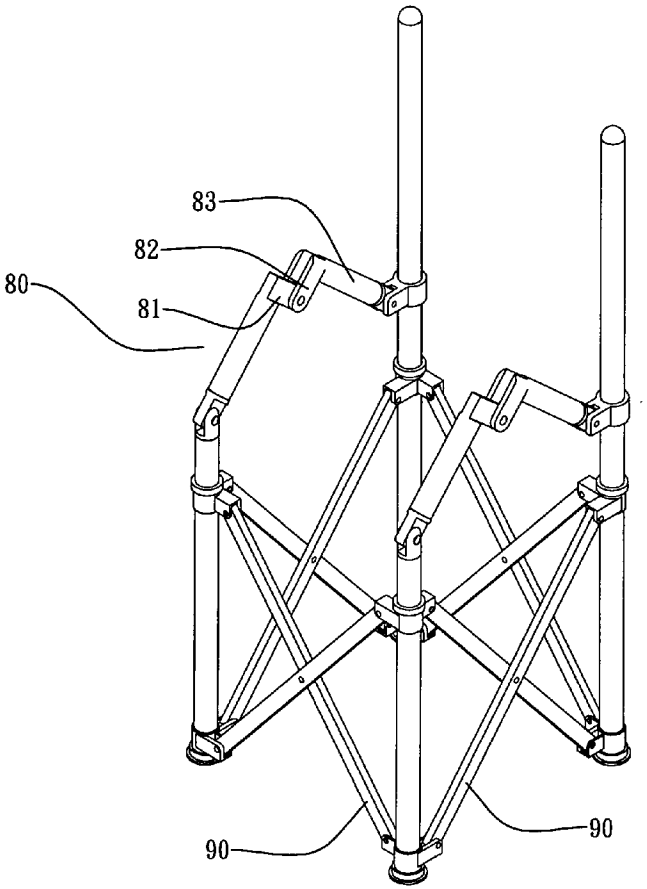
Fig. 8 Prior art
FIG. 8 is a perspective view of the arm rest unit of the foldable chair in bending position according to the conventional invention.
Figure 9:
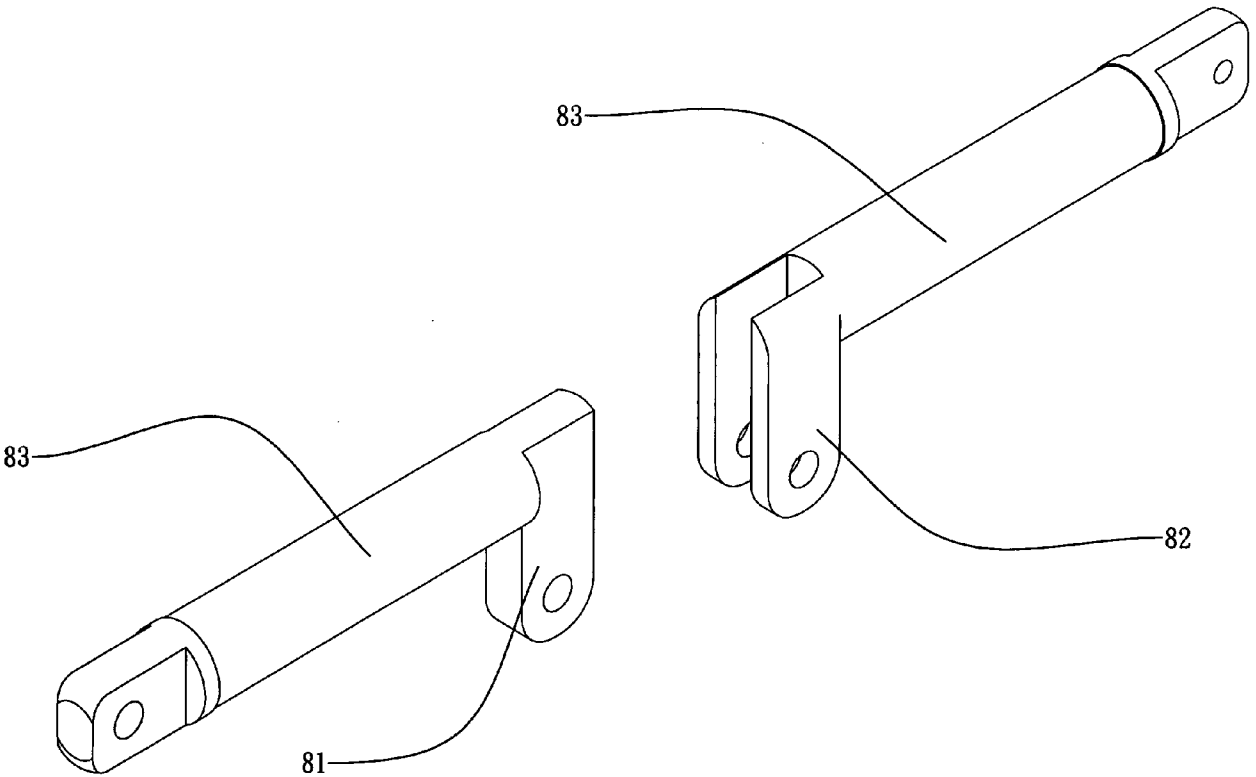
Fig. 9 Prior art
FIG. 9 is an exploded view of the armrest rod of the foldable chair of the conventional invention.
Figure 10:
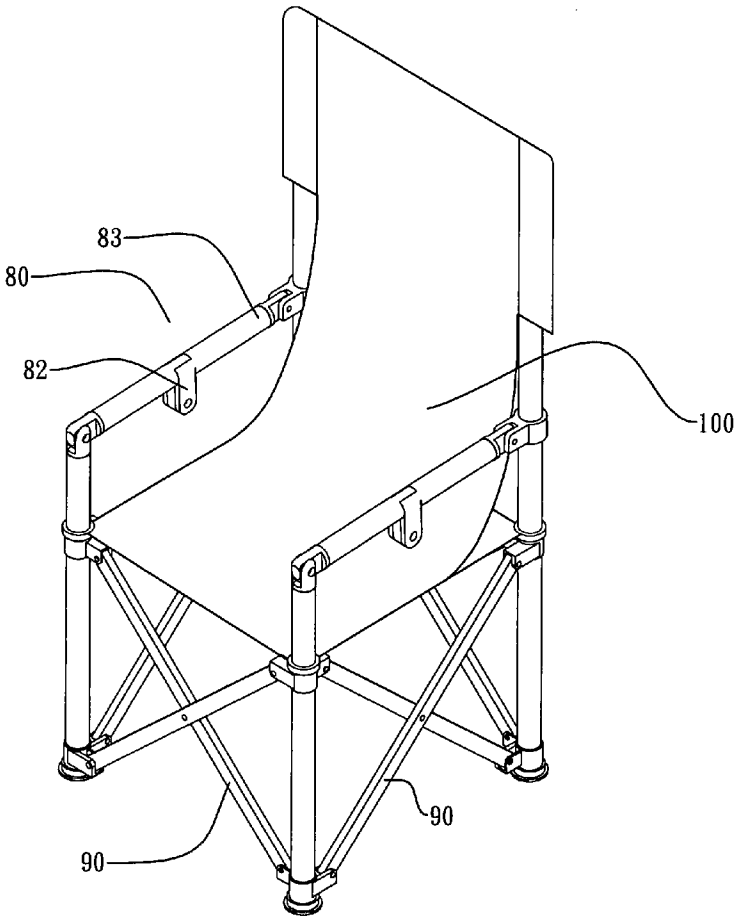
Fig. 10 Prior art
FIG. 10 is a perspective view of the conventional invention.

Please refer to the FIGS. 7, 8 of the prior art, each side of the frame structure is formed with the X-shaped supporting unit (90) with the same length. During folding, all sides of the supporting units are folded at the same time. Therefore, each armrest unit (80) must adapt a male terminal (81) engaging with a female terminal (82) and an armrest rod (83) to form a folding armrest which is allowed to bend from the middle section.

Figure 1:
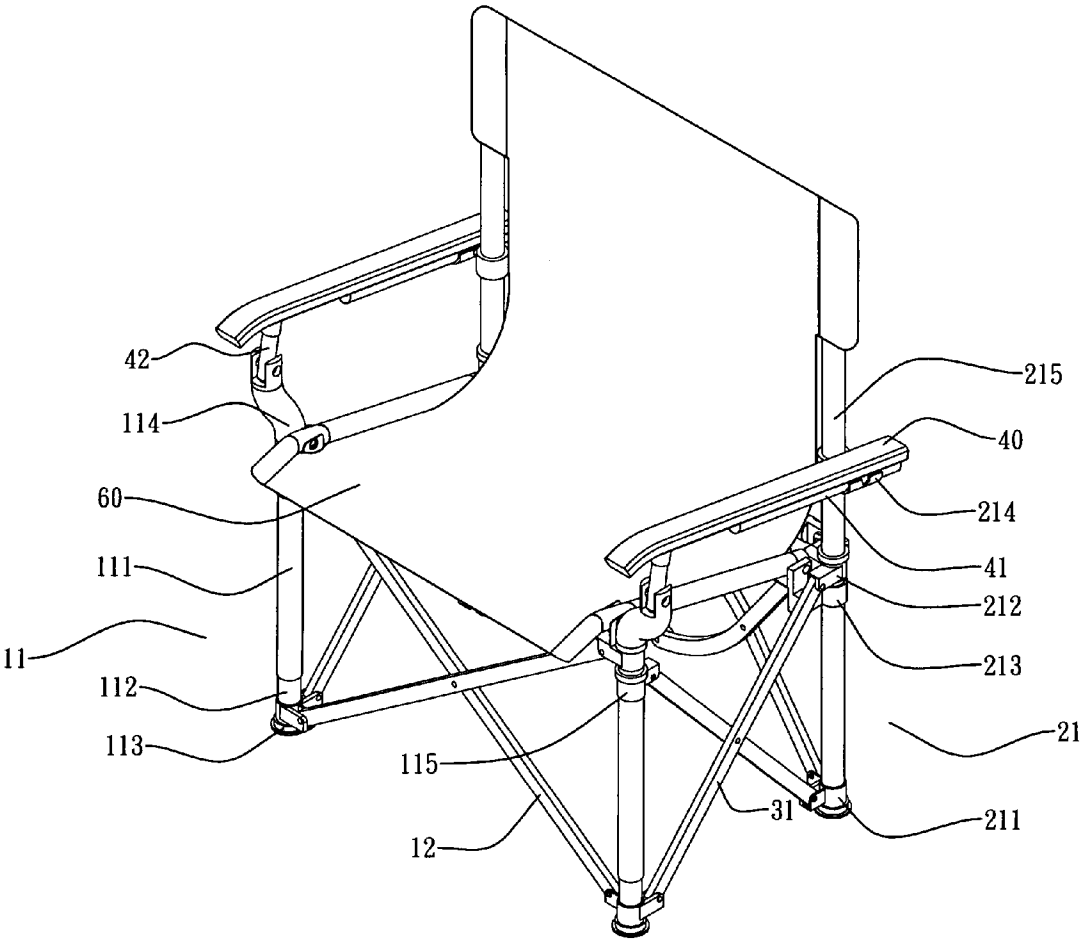
FIG. 1 is a perspective view of the preferred embodiment according to the present invention.
Figure 2:
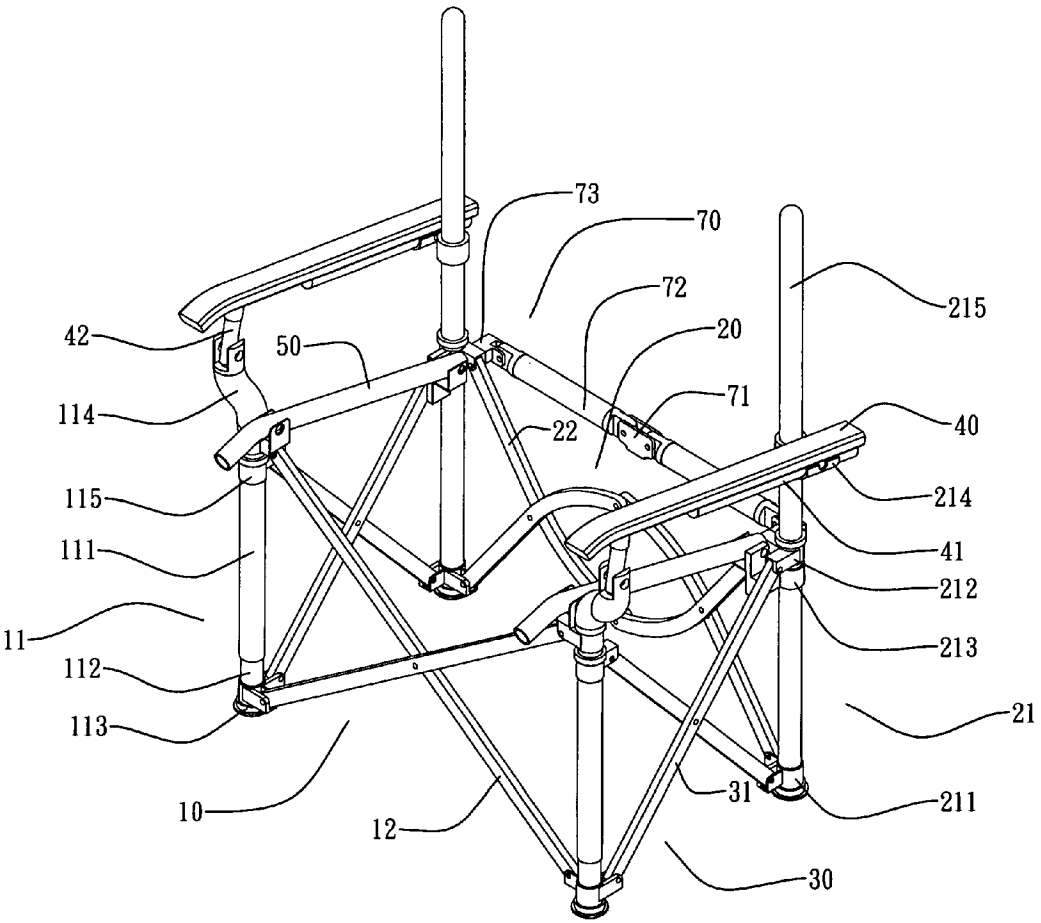
FIG. 2 is a perspective view of the foldable chair frame structure in extension position of the preferred embodiment according to the present invention.

As shown is FIG. 2 of the present invention, the front leg unit (11) and the rear leg unit (21) are parallel to each other and perpendicular to the floor allowing being folded and extended longitudinally. The seat supporting unit (50) is installed between the front leg unit (11) and the rear leg unit (21) allowing the seat unit (60) installing through to solve the problem of the prior art of which the seat unit (100) only extending from four point of the front and rear leg unit without any supporting frame.

As shown in FIG. 2 of the present invention, the front interconnecting supporting unit (10) and the rear interconnecting supporting unit (20) adapt the crisscrossed supporting unit (12) and the arc-shaped supporting unit (22) in different length. The folding period of the front interconnecting supporting unit (10) which is composed of X-shaped supporting frame is longer than the rear interconnecting supporting unit (20) which is formed with a U and a reversed U-shaped frames pivotally connected to each other. Please refer to FIG. 3, the distance between the receiving joint (114) and the front gliding sleeve (115) is the folding period of the front interconnecting supporting unit (10); the distance between the rear gliding sleeve (212) and the mounting sleeve (213) represents the folding period of the rear interconnecting supporting unit (20) which is apparently shorter than that of the front interconnecting supporting unit (10). Thus, when folding the whole structure, the uprising speed of the receiving joint (114) of the upper portion of the front leg unit (111) is faster than that of the rear gliding sleeve (212) of the rear leg rod (215) which means the front interconnecting supporting unit (10) is able to complete the folding process synchronously when the lateral interconnecting supporting unit (30) and the rear interconnecting supporting unit (20) complete the folding process. The advantages of the present invention are as following:

Firstly, the connecting member (42) extending downwardly from the bottom of the armrest unit (40) eliminates the problem of folding the structure by lengthening the folding distance of the lateral interconnecting supporting unit (30) instead of adapting a set of the armrest unit (80) which is weak in structure and exists safety concern.

Secondly, the seat unit (60) engaged through the seat supporting unit (50) is supported by the seat supporting unit (50) which becomes not only more stabilized and safer than the seat unit (100) of the prior art but more likely to prevent it from tearing for suffering stress. Thirdly, the structure of the preferred embodiment can also be applied into table, chair or bed which is full of practicality.

Figure 6:
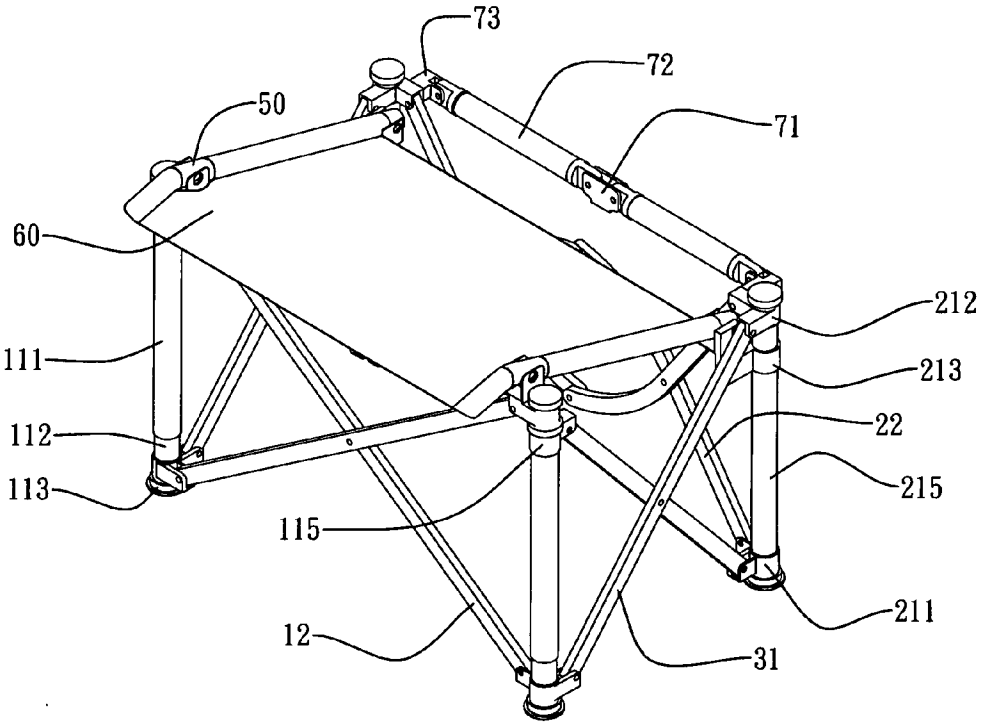
FIG. 6 is a perspective view of the arrangement example of a foldable chair according to the present invention.

As for FIG. 6, an arrangement example of the preferred embodiment, it eliminates the structure of the receiving joint (114), the armrest unit (40), the rod-bracket track (214) and a suitable length of the upper portion of the front leg unit (111) and the rear leg unit (215) so as to form a foldable chair without the armrest structure.

I claim:

1. A frame structure for a foldable chair comprising:

an front interconnecting supporting unit having a front leg unit, a crisscrossed supporting unit installed thereon, wherein each of said front leg unit is composed of a upper portion of said front leg unit, a lower portion of said front leg unit, a front base cap, receiving joint and a front gliding sleeve;

a rear interconnecting supporting unit being installed with a rear leg unit, an arc-shaped supporting unit, wherein each of said rear leg unit is installed with a rear base cap, a first rear gliding sleeve, a second rear gliding sleeve, a rod-bracket track, and a rear leg rod;

wherein said front leg unit and said rear leg unit are parallel to each other and perpendicular to the ground where it is allowed to be folded and extended longitudinally;

a lateral interconnecting supporting unit being composed of two board members pivotally connected with each other between said front leg unit and said rear leg unit;

a transverse supporting rod having a connecting plate, a rod and a connecting joint installed thereon;

a seat supporting unit and an armrest unit being installed between said front and rear leg unit respectively, wherein said seat supporting unit is provided for a seat unit to engage through; wherein said seat supporting unit is composed of a curved front portion and straight rear portion engaged with said second rear gliding sleeve positioned on said rear leg unit; wherein each of said receiving joint of said front leg unit is suitably engaged with the front portion of said seat supporting unit allowing said seat supporting unit being positioned between said front leg unit and said rear leg unit; beneath said armrest unit, a connecting member protruding there from and a gliding rod extending along the bottom of said armrest unit which can be pivotally engaged with said receiving joint of said front leg and sliding through said rod-bracket track respectively allowing said armrest unit being positioned on the top of said seat supporting unit.

2. A frame structure for a foldable chair as claimed in claim 1, wherein said rod-bracket track is in semi-cylinder shape and installed on the top of said rear gliding sleeve allowing to be rotated forward and backward.

3. A frame structure for a foldable chair as claimed in claim 1, wherein one end of said armrest unit arises along with said receiving joint of said front leg unit, and another end of said armrest unit simultaneously rotates upward against rod-bracket track during folding process.

4. A frame structure for a foldable chair as claimed in claim 1, wherein said front leg unit, armrest unit, rod-bracket track and a suitable length of said upper portion of said front leg unit and said rear leg unit are allowed to be eliminated so as to form a foldable chair without armrest unit.

* * * * *